US007377413B2

(12) United States Patent
Wen

(10) Patent No.: US 7,377,413 B2
(45) Date of Patent: May 27, 2008

(54) PNEUMATIC NAIL GUN

(75) Inventor: Wan-Fu Wen, Taipei Hsien (TW)

(73) Assignee: De Poan Pneumatic Corp., Taipei (TW)

( * ) Notice: Subject to any disclaimer, the term of this patent is extended or adjusted under 35 U.S.C. 154(b) by 0 days.

(21) Appl. No.: 11/465,374

(22) Filed: Aug. 17, 2006

(65) Prior Publication Data

US 2008/0006670 A1 Jan. 10, 2008

(30) Foreign Application Priority Data

Jul. 5, 2006 (TW) ..... 95124436 A

(51) Int. Cl.
*B25C 1/04* (2006.01)

(52) U.S. Cl. ..... 227/8; 227/130; 123/46 SC

(58) Field of Classification Search ..... 227/8, 227/10, 130, 136; 123/46 SC
See application file for complete search history.

(56) References Cited

U.S. PATENT DOCUMENTS 4,030,655 A * 6/1977 Rothfuss et al. ..... 227/130
4,294,391 A * 10/1981 Obergfell ..... 227/130
4,448,338 A * 5/1984 Graf et al. ..... 227/8
4,784,308 A * 11/1988 Novak et al. ..... 227/130
5,020,712 A * 6/1991 Monacelli ..... 227/8
5,441,192 A * 8/1995 Sugita et al. ..... 227/130
5,485,946 A * 1/1996 Jankel ..... 227/8
5,873,510 A * 2/1999 Hirai et al. ..... 227/130
5,911,351 A * 6/1999 White ..... 227/130
6,145,727 A * 11/2000 Mukoyama et al. ..... 227/130
6,164,510 A * 12/2000 Deieso et al. ..... 227/130
6,260,519 B1 * 7/2001 Phillips ..... 123/46 R
6,520,397 B1 * 2/2003 Moeller ..... 227/130
6,533,156 B1 * 3/2003 Chang ..... 227/130
6,779,699 B2 * 8/2004 Aoki et al. ..... 227/130
7,014,089 B2 * 3/2006 Ishizawa et al. ..... 227/130
7,290,691 B1 * 11/2007 Wen ..... 227/8
7,293,684 B1 * 11/2007 Wen ..... 227/130

* cited by examiner

*Primary Examiner*—Scott A. Smith

(57) ABSTRACT

A pneumatic nail gun includes a gun body, a movable cylinder, a piston and a slidable sleeve valve. The gun body has a main air housing collecting a compressed high pressure air with a constant pressure, and a trigger at one end of the main air housing driving the high pressure air to shoot a nail. The movable cylinder is disposed in the main housing, which moves upward when the trigger is pressed, and moves downward for reposition when the trigger is released. The piston is slidably movably disposed in the cylinder, which has a driver blade extending from the piston. The driver blade protrudes out of the gun body for punching against the nail in accordance with a downward movement of the piston. The slidable sleeve valve is assembled at an outer peripheral surface of the cylinder, which introduces high pressure air to drive the piston move upward when the cylinder moves downward to its lower dead center, and is driven downward after the piston moves to its upper dead center.

7 Claims, 13 Drawing Sheets

PNEUMATIC NAIL GUN

BACKGROUND

The present invention relates to a pneumatic nail gun, and particularly to a pneumatic nail gun having a movable cylinder and slidable sleeve valve.

Pneumatic nail gun generally utilizes a compressed high pressure air to drive a piston to punch a nail, for joining two objects by shooting a nail through both objects. A conventional pneumatic nail gun can be classified into two kinds, one kind being coupled with a magazine, another kind being coupled with a canister. The magazine generally contains the T-shaped or I-shaped nail rows and utilizes an elastic deformation force of a spring to drive each nail to the nail feeding mechanism. The canister contains full-round head strings of larger nails, which is combined with a nail pusher. The nail pusher utilizes a high pressure air and spring to drive each nail to the nail feeding mechanism.

The general structure and function of a nail gun is briefly introduced as follows. A nail gun has a gun body, the gun body having a gun handle and a gun head; a fastening cylinder disposed in the gun head; a high-pressure air pipe coupled to one end of the gun handle, and a high-pressure air being input and introduced into the cylinder; a piston disposed in the cylinder, the piston connected to a nail shooting mechanism at the external end of the gun head, and the nail shooting mechanism coupled to a nail magazine. When the nail gun is triggered, and the piston is pushed outward by the air pressure such that the nail shooting mechanism can shoot out the nail at the nailing position. In addition, an air chamber is provided at an outer peripheral surface, which receives high pressure air from the cylinder to drive the piston to its original position when the piston moves to its lower dead center.

However, the air chamber just can receive the high pressure air when the piston moves downward and be closed when the piston moves upward. That is the air chamber can not receive high pressure air when the piston moves upward. Thus, the collection of the high pressure air in the air chamber for upward movement of the piston is limited, and the stability of the upward movement of the piston is lower. Especially, in the process of continuous nail punching, the instability of upward movement of the piston lowers the speed and efficiency of nail punching.

For resolving the problem, one method of adding the cubage of the air chamber is provided in recently technology. However, the method still is not an ideal resolution.

Accordingly, what is needed is a pneumatic nail gun that can overcome the above-described deficiencies.

BRIEF SUMMARY

A pneumatic nail gun of the present invention includes a gun body, a movable cylinder, a piston and a slidable sleeve valve. The gun body has a main air housing collecting a compressed high pressure air with a constant pressure, and a trigger at one end of the main air housing driving the high pressure air to shoot a nail. The movable cylinder is disposed in the main housing, which moves upward when the trigger is pressed, and moves downward for reposition when the trigger is released. The piston is slidably movably disposed in the cylinder, which has a driver blade extending from the piston. The driver blade protrudes out of the gun body for punching against the nail in accordance with a downward movement of the piston. The slidable sleeve valve is assembled at an outer peripheral surface of the cylinder, which introduces high pressure air to drive the piston move upward when the cylinder moves downward to its lower dead center, and is driven downward after the piston moves to its upper dead center.

In an alternative modification, the pneumatic nail gun further includes a head valve positioned above and integrated on the cylinder; a first air chamber formed between a top end of the head valve and an inner peripheral surface of the gun body; and a second air chamber formed between the head valve and inner peripheral surface of the gun body. The first air chamber receives high pressure air from the main air housing when the trigger is released, and exhausts the high pressure air when the trigger is pressed. The second air chamber receives the high pressure air from the main air housing and drives the cylinder move upward when the high-pressure air in the first air chamber is discharged.

In another alternative modification, the pneumatic nail gun further has a nail injecting passage formed in a bottom of the gun body, which connects with the fourth air chamber. The nail injecting passage is closed by the bottom valve when the sleeve valve moves downward, and guides the high pressure air in the fourth air chamber to inject the nail when the sleeve valve moves upward.

The pneumatic nail gun utilizes the movable cylinder and the slidable sleeve valve efficiently control the transmission of the compressed high pressure air. Especially, The pneumatic nail gun continuously supplies the compressed high pressure air with a constant pressure to realize the stably upward movement of the piston, which increase the reposition speed and stability of the upward movement of the piston. In addition, the pneumatic nail gun further provides a nail injecting passage. When the pneumatic nail gun cooperates with a nail injecting mechanism driven by a high pressure air and the elastic deformation force of a spring, the nail injecting passage can provide enough high pressure air to inject the nails contained in the canister.

BRIEF DESCRIPTION OF THE DRAWINGS

These and other features and advantages of the various embodiments disclosed herein will be better understood with respect to the following description and drawings, in which like numbers refer to like parts throughout, and in which.

DETAILED DESCRIPTION

Figure 1:
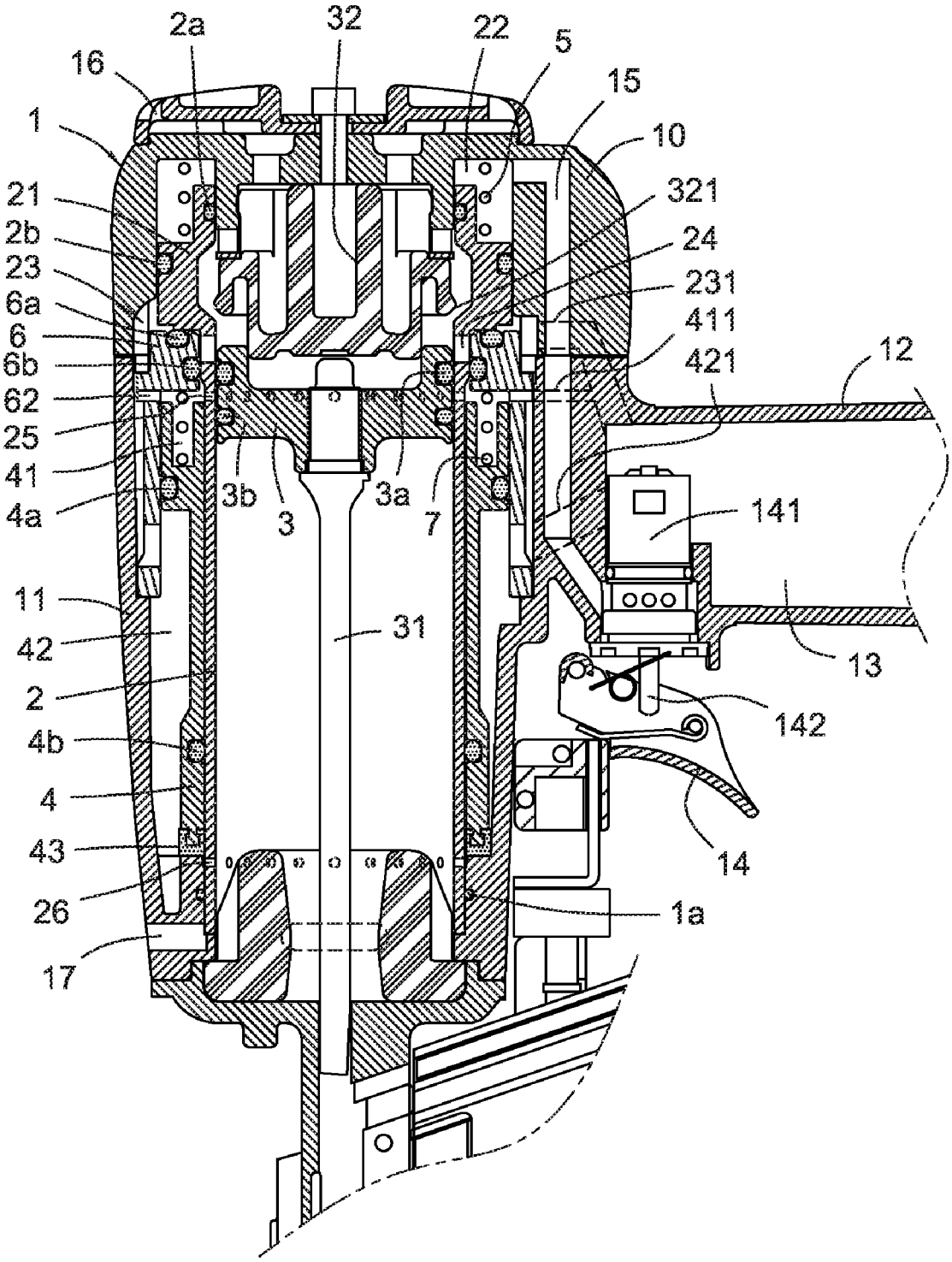
FIG. 1 is a cross-sectional view of pneumatical nail gun according to a first embodiment of the present invention, the pneumatical nail gun having a movable cylinder and a slidable sleeve valve.

Referring to FIG. 1, a pneumatic nail gun according to a first embodiment of the present invention is shown. The pneumatic nail gun has a gun body 1, a movable cylinder 2, a piston 3, a slide sleeve valve 4.

Figure 2:
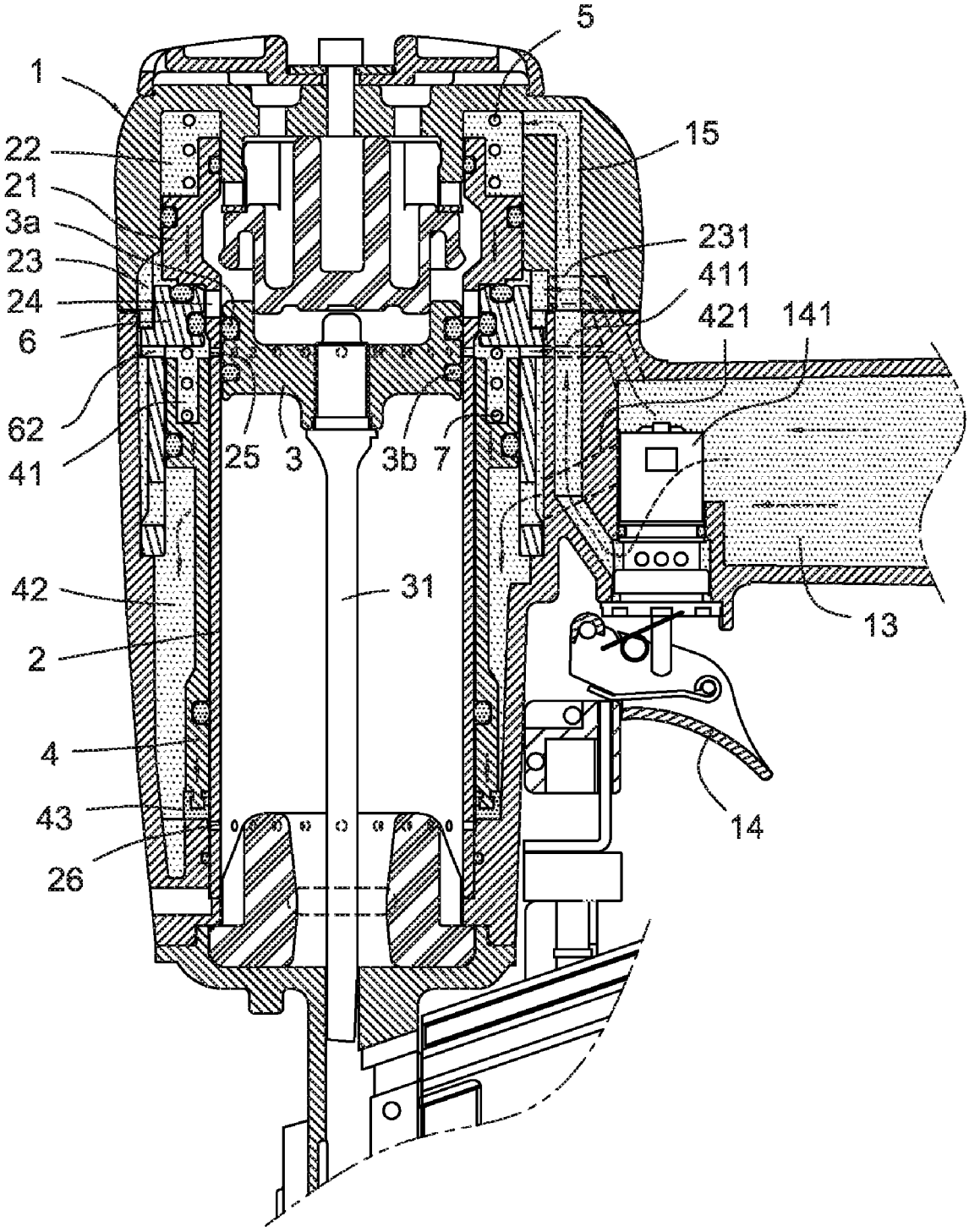
FIG. 2 is a cross-sectional view of the pneumatical nail gun of FIG. 1, showing a state of high pressure air gathered in a main air housing, a first air chamber, a second air chamber, a third air chamber and a fourth air chamber of the pneumatical nail gun.
Figure 3:
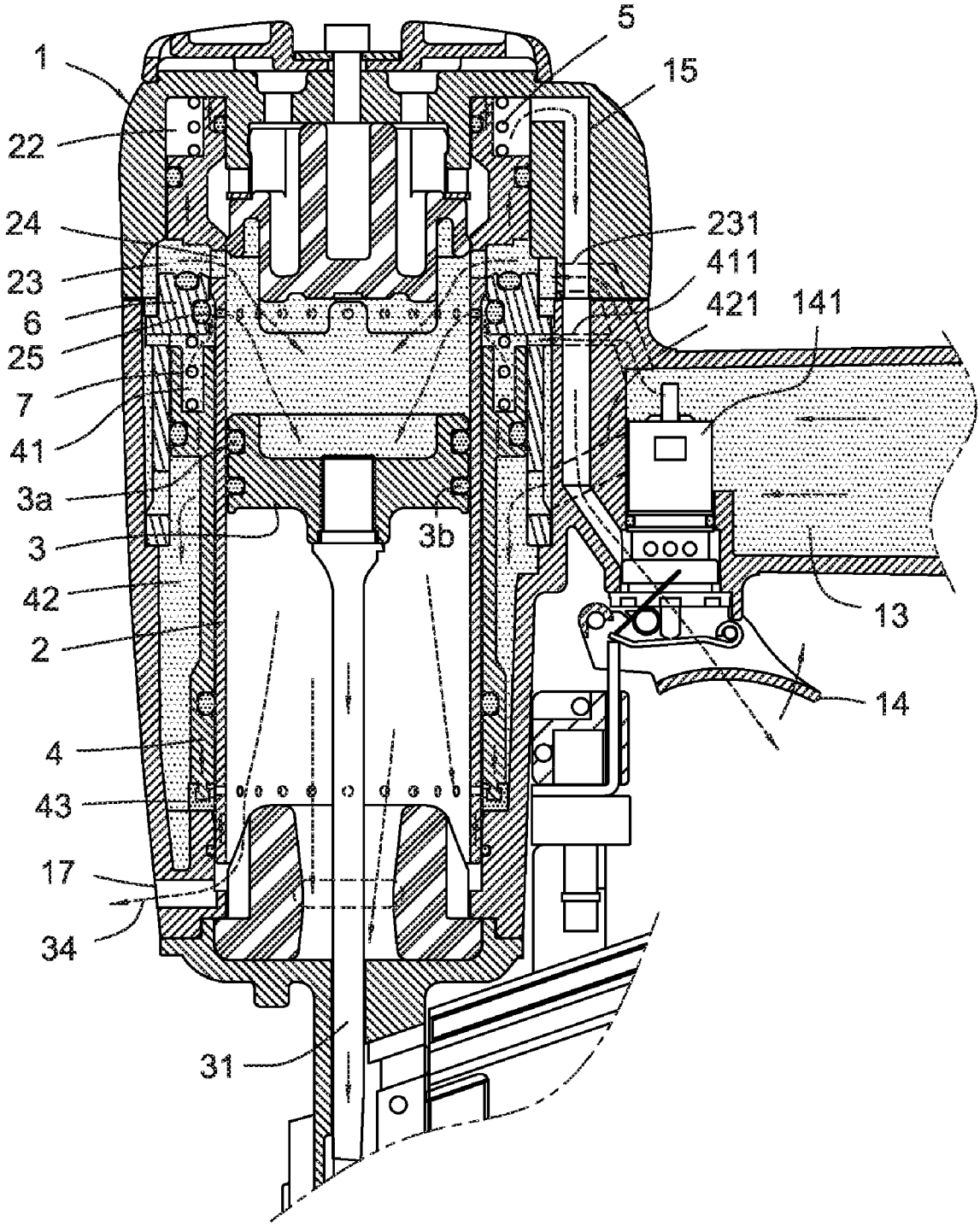
FIG. 3 shows a cross-sectional view of the pneumatical nail gun of FIG. 1, showing a state of upward movement of the movable cylinder when the high pressure air is exhausted from the first air chamber, and downward movement of a piston of the pneumatical nail gun driven by the high pressure air in the second air chamber, when a trigger is pressed.
Figure 4:
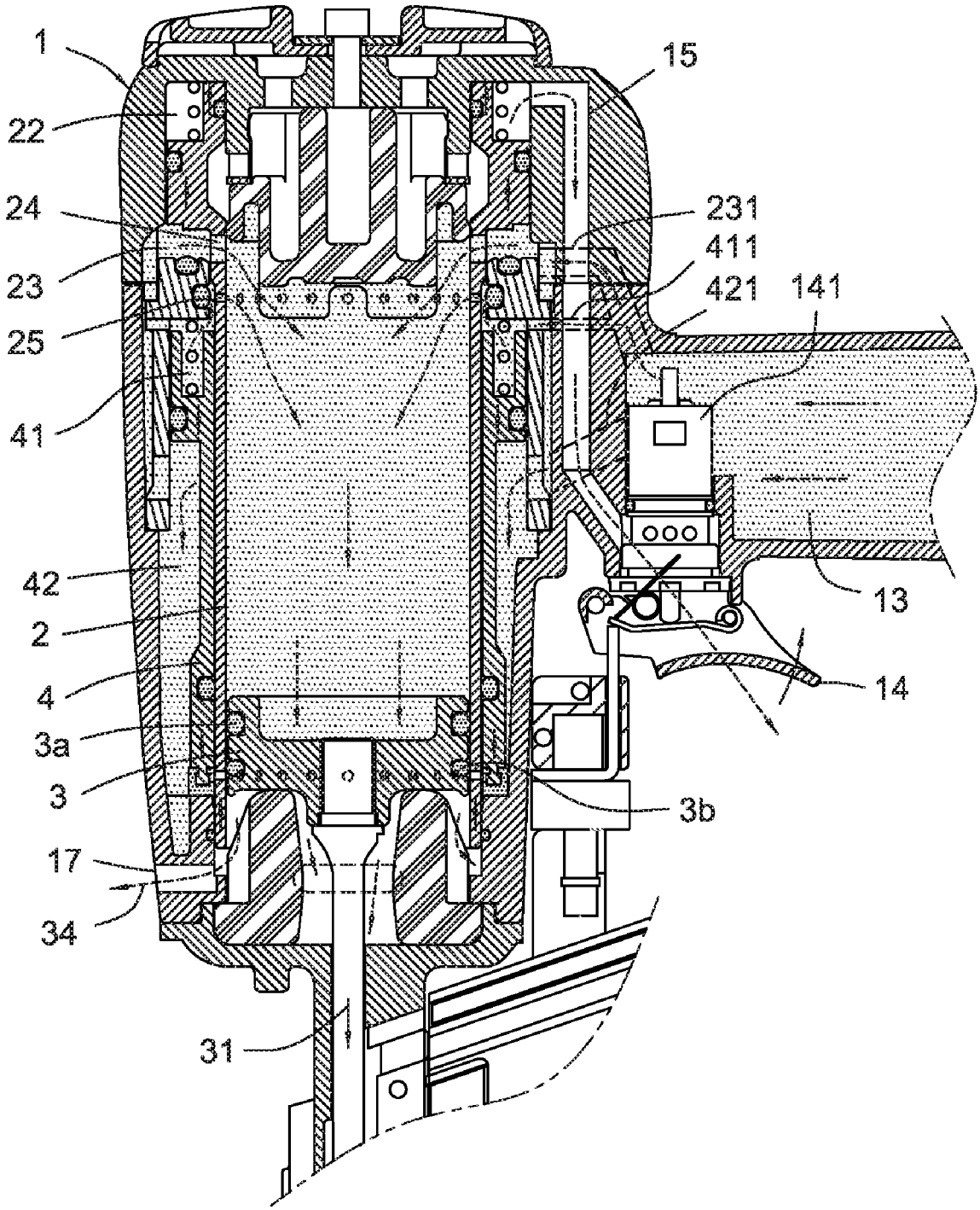
FIG. 4 shows a cross-sectional view of the pneumatical nail gun of FIG. 1, showing a state after the trigger is pressed, wherein the piston moves downward to a lower dead center and high pressure air below the piston is exhausted to atmosphere.

The gun body 1 includes a gun head 11, a gun head cap 10 integrally therewith, a trigger 14 and a trigger valve 141. The gun head 11 has a handle 12, a main air housing 13 formed in the handle 12 for supplying a compressed high-pressure air therein (as shown in FIG. 2). The trigger 14 is provided near the handle 12 and at one end of the main air housing 13, and the trigger valve 141 is disposed in the main air housing 13 to be operated by the manipulation of the trigger 14 through pressing a trigger valve rod 142 connecting to the trigger valve 141. The trigger valve 141 provides a first valve position by the manipulation to the trigger 14 to fluidly communicate the main air housing 13 and a first air chamber 22 in the gun body 1 with the high pressure air, and provides a second valve position by non-manipulation to the trigger 14 to shut off the fluid communication between the main air housing 13 and the first air chamber 22 (as shown in FIG. 3 & FIG. 4).

Figure 5:
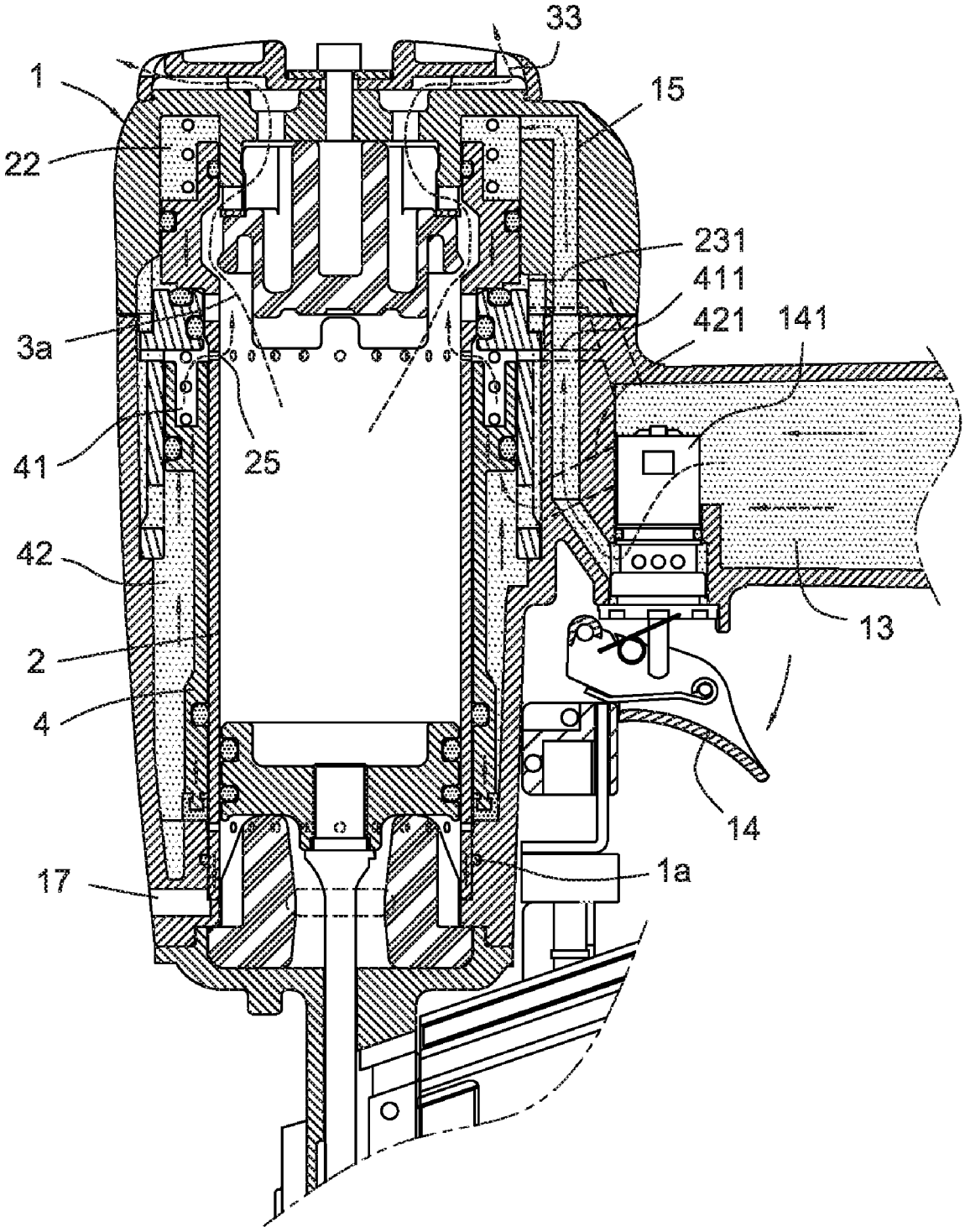
FIG. 5 shows a cross-sectional view of the pneumatical nail gun of FIG. 1, showing a state of the high pressure air re-collecting into the first air chamber for downwardly repositing the movable cylinder, when the trigger is released, and the high pressure air in the third air chamber being discharged and the slidable sleeve valve is about to move upward.

The movable cylinder 2 is disposed in the gun body 1. The movable cylinder 2 is driven to move upward by the high pressure air when the trigger 14 is pressed, and is driven to move downward for repositing when the trigger 14 is released (as shown in FIG. 3). The movable cylinder 2 has a plurality of top vent holes 24 at a top end portion thereof, a plurality of intermediate vent holes 25 at an intermediate position thereof, and a plurality of bottom vent holes 26 at a bottom end portion thereof, on a peripheral sidewall (not labeled) thereof (as shown in FIG. 2 & FIG. 5).

The piston 3 is slidably and reciprocally movably disposed in the cylinder 2, and a driver blade 31 extends from a lower end surface (not labeled) of the piston 3. A tip end of the driver blade 31 can protrude out of the gun body 1 for punching against a nail in accordance with a downward movement of the piston 3 (as shown in FIG. 3 & FIG. 4). In addition, two annular ring grooves (not labeled) are formed in an outer peripheral surface of the piston 3, two O-rings 3*a*, 3*b* are assembled in the two ring grooves, respectively. The two O-rings 3*a*, 3*b* are made from a resilient or elastic material such as rubber to provide sealing contact between the cylinder 2 and the piston 3.

Figure 6:
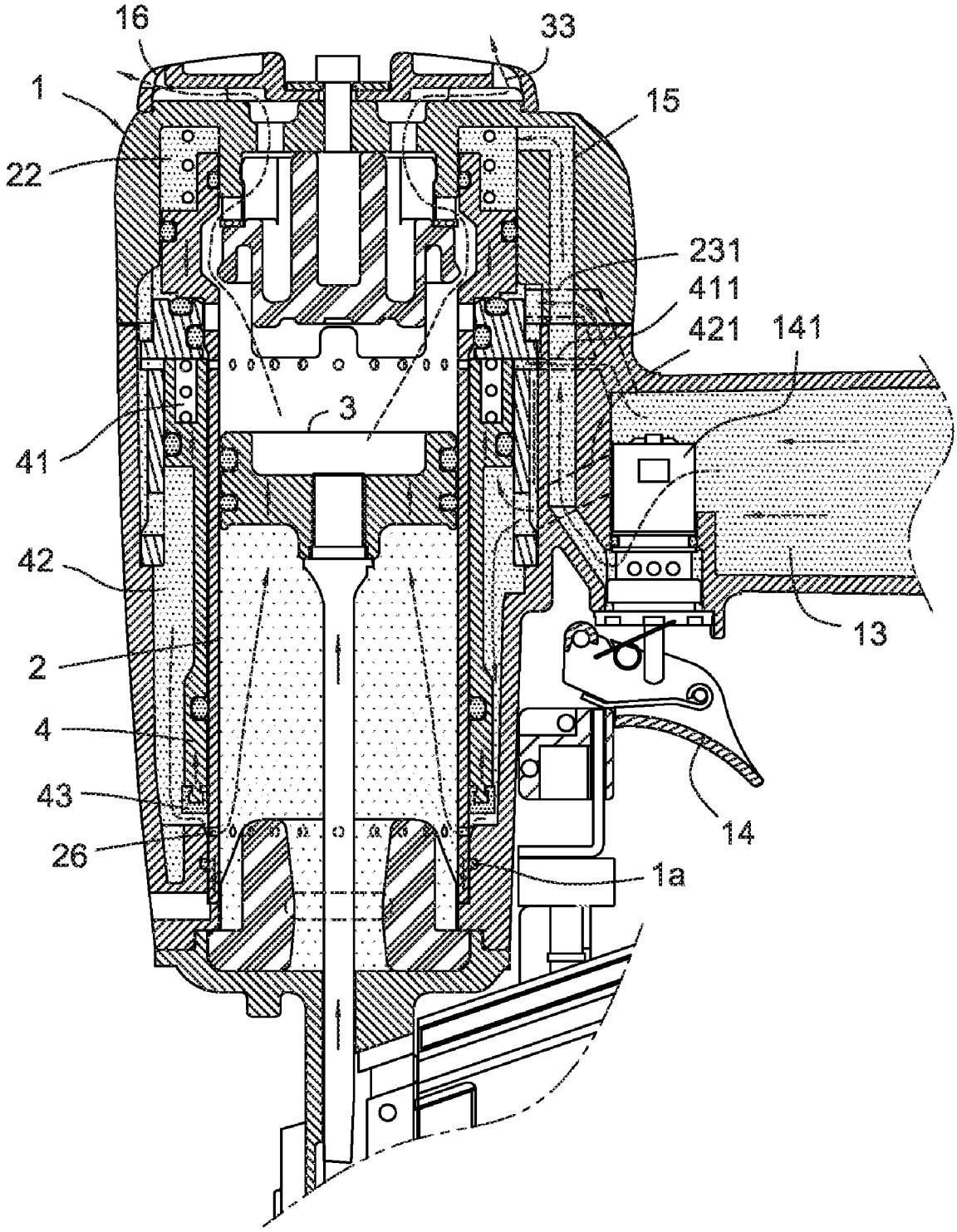
FIG. 6 shows a cross-sectional view of the pneumatical nail gun of FIG. 1, showing a state after the trigger is released, wherein the slidable sleeve valve moves upwards and the high pressure air is guided into the cylinder from the fourth air chamber to drive the piston move upwardly.

The slidable sleeve valve 4 is disposed at an out peripheral surface of the cylinder 2. When the cylinder 2 move downward for reposition, the slidable sleeve valve 4 is driven to move upward by the high pressure air (as shown in FIG. 6), and when the piston 3 moves upward for reposition, the slidable sleeve valve 4 is driven to move downward for reposition (as shown in FIG. 2).

A head valve 21 is positioned above and is integrated on the cylinder 2. The first air chamber 22 is formed between an top end of the head valve 21 and an inner peripheral surface of the gun body 1. Two O-rings 2*a*, 2*b* are assembled in an inner ring groove (not labeled) and an outer ring groove (not labeled) of the head valve 21, respectively, to provide air-sealing of the first air chamber 22. Before the trigger 14 is pressed (as shown in FIG. 2 & FIG. 5), the first air chamber 22 fluidly communicate with the main air housing 13 through a trigger passage 15 formed in the gun body 1, wherein the compressed high-pressure air in the main air housing 13 flows into the first air chamber 22 and the high-pressure air drives the cylinder 2 to move downward. When the trigger 14 is pressed (as shown in FIG. 3 & FIG. 4), the trigger valve 141 shut off the trigger passage 15 between the main air housing 13 and the first air chamber 22 and the compressed high-pressure air in the first air chamber 22 is discharged therefrom.

A second air chamber 23 is formed between the head valve 21 and inner peripheral surface of the gun body 1. The second air chamber 23 fluidly communicates with the main air housing 13 through a second passage 231 formed around a peripheral outer surface of the second air chamber 23 for guiding the compressed high-pressure air in the main air housing 13 into the second air chamber 23. The high-pressure air in the second air chamber 23 drives the cylinder 2 to move upward when the high-pressure air in the first air chamber 22 is discharged (as shown in FIG. 3 & FIG. 4).

A top spring 5 is disposed in the first air chamber 22. When the first air chamber 22 is charged with the high-pressure air (as shown in FIG. 2 & FIG. 5), a sum of an elastic deformation force of the top spring 5 and a pressure thrust of the high-pressure air in the first air chamber 22 is larger than a pressure thrust of the high-pressure air in the second air chamber 23, which assures the cylinder 2 stably downward movement. When the high-pressure air in the first air chamber 22 is discharged therefrom (as shown in FIG. 3 & FIG. 4), the elastic deformation force of the top spring 5 is smaller than the pressure thrust of the high-pressure air in the second air chamber 23, which assures the cylinder 2 stably upward movement.

A normal valve 6 is disposed between the second air chamber 23 and the cylinder 2, which is fixed on an inner peripheral surface of the gun body 1. The normal valve 6 has two O-rings 6*a*, 6*b* assembled in two annular ring grooves (not labeled) formed in two side surfaces of the normal valve 6, respectively, adjacent to outlet ends of the plurality of top vent holes 24. The O-rings 6*a*, 6*b* have a sealing function for sealing the fluid communication of the second air chamber 23 with the top vent holes 24, and a third air chamber 41 in the gun body 1 with the top vent holes 24. Thus, when the cylinder 2 moves upward (as shown in FIG. 3 & FIG. 4), the normal valve 6 can allow compressed air to pass from the second air chamber 23 to the cylinder 2 through the top vent holes 24, which drives the piston 3 to move downward to punch a nail; and when the cylinder 2 moves downward for reposition, the normal valve 6 can close the top vent holes 24 (as shown in FIG. 2 & FIG. 5).

An exhausting hole 16 is formed at a top of the gun body 1, which defines an exhausting passage 33 (as shown in FIG. 5 & FIG. 6) with the cylinder 2 and the piston 3 for discharging compressed high pressure air to an atmosphere. In addition, a top bumper 32 is positioned between the exhausting hole 16 and the cylinder 2, which has a flange 321 formed at a peripheral of a bottom end (not labeled). The flange 321 closes the exhausting passage 33 (as shown in FIG. 3 & FIG. 4) when the cylinder 2 moves upward for driving the piston 3 to move downward to punch the nail, and opens the exhausting passage 33 (as shown in FIG. 5 & FIG. 6) when cylinder 2 moves downward and the piston 3 moves upward for reposition.

The third air chamber 41 is positioned between the slidable sleeve valve 4 and the inner peripheral surface (not labeled) of the gun body 1. The third air chamber 41 has a third passage 411 formed around peripheral thereof fluidly communicating with the main air housing 13 for guiding compressed high-pressure air into the third air chamber 41. The high-pressure air in the third air chamber 41 drives the slidable sleeve valve 4 to move downward to its lower dead center (as shown in FIG. 2).

The plurality of intermediate vent holes 25 formed at a middle region of the cylinder 2, connects with the third air chamber 41. When the trigger 14 is released, the cylinder 2 moves downward and the high-pressure air in the third air chamber 41 is guided into the cylinder 2 through the plurality of intermediate vent holes 25 formed thereon (as shown in FIG. 5).

A fourth air chamber 42 is formed between an inner peripheral surface of the gun body 1 and an outer peripheral surface of the slideable sleeve valve 4. The fourth air chamber 42 has a fourth passage 421 formed around peripheral thereof, which fluid communicates with the main air housing 13 to guide compressed high-pressure air in the main air housing 13 to the fourth air chamber 42 (as shown in FIG. 2 to FIG. 4). The high pressure air in the fourth air chamber 42 drives the slidable sleeve valve 4 to move upward when the high-pressure air in the third air chamber 41 is discharged (as shown in FIG. 5 & FIG. 6).

A bottom valve 43 is fixedly positioned at a bottom end portion of the slidable sleeve valve 4, which is covered by a layer of heat-resistant material and shock-absorbing material, such as rubber. The bottom valve 43 can close the fluid communication between the fourth air chamber 421 and the bottom vent holes 26 when the slidable sleeve valve 4 moves downward (as shown in FIG. 2 to FIG. 4), and guides the high-pressure air in the fourth air chamber 42 into the cylinder 2 through the plurality of bottom vent holes 26 to drive the piston 3 to reposit upward (as shown in FIG. 6).

A bottom spring 7 is disposed in the third air chamber 41. When the third air chamber 41 is charged with the high-pressure air (as shown in FIG. 2 to FIG. 4), a sum of an elastic deformation force of the bottom spring 7 and a pressure thrust of the high-pressure air in the third air chamber 41 is larger than a pressure thrust of the high-pressure air in the fourth air chamber 42, which assures stably downward movement of the slidable sleeve valve 4. When the high-pressure air in the third air chamber 41 is discharged therefrom, the elastic deformation force of the bottom spring 7 is smaller than the pressure thrust of the high-pressure air in the fourth air chamber 42, which assures stably upward movement of the slidable sleeve valve 4 (as shown in FIG. 5 & FIG. 6).

The third air chamber 41 is formed at a bottom end of the normal valve 6. The normal valve 6 further has a plurality of normal valve vent holes 62 (as shown in FIG. 2) connecting the third passage 411 and the third air chamber 41 for the fluid communication therebetween. In addition, a sum of an actual fluid communication area of the plurality of normal valve vent holes 62 is far smaller than that of the plurality of intermediate vent holes 25. Thus, when the trigger 14 is released and the cylinder 2 moves downward (as shown in FIG. 5), the intermediate vent holes 25 can guide the high-pressure air in the third air chamber 41 into the cylinder 2.

The intermediate vent holes 25 are opened when the piston 3 moves downward for punching the nail and is closed when the piston 3 moves upward for repositing, i.e. when the piston 3 moves downward (as shown in FIG. 3 & FIG. 4) and the two O-rings 3*a*, 3*b* are brought far away from the intermediate vent holes 25, the intermediate vent holes 25 guides a part of the high-pressure air in the third air chamber 41 into the cylinder 2, and when the piston 3 moves upward to its upper dead center (as shown in FIG. 2), the intermediate vent holes 25 are located between the two O-rings 3*a*, 3*b*, and the two O-rings 3*a*, 3*b* close the fluid communication between the third air chamber 41 and the cylinder 2 through the intermediate vent holes 25.

The slidable sleeve valve 4 has two O-rings 4*a*, 4*b* respectively assembled in an outer peripheral surface (not labeled) and an inner peripheral surface (not labeled) of the slidable sleeve valve 4. The O-ring 4*a* in the outer peripheral surface provides sealing contact between the outer peripheral surface of the slidable sleeve valve 4 and its cooperating surface when the sleeve valve 4 is driven to move upward by the high-pressure air in the fourth air chamber 42. The O-ring 4*b* in the inner peripheral surface provides sealing contact between the fourth and the third air chamber 42, 41.

A bottom exhausting hole 17 is formed at a bottom of the gun body 1, which defines a bottom exhausting passage 34 (as shown in FIG. 3 and FIG. 4) with the cylinder 2 and the piston 3 for discharging compressed high pressure air to an atmosphere. When the cylinder 2 moves upward, the bottom exhausting hole 17 is opened, and when the cylinder 2 moves downward (as shown in FIG. 5 & FIG. 6), the bottom exhausting hole 17 is closed. In addition, a bottom O-ring 1*a* is assembled in an inner peripheral surface of gun body 1, adjacent to the fourth air chamber 42, the bottom exhausting hole 17, and the bottom vent holes 26. The bottom O-ring 1*a* can close the fluid communication between the fourth air chamber 42, the bottom exhausting hole 17, and the bottom vent holes 26.

In operation, before the trigger 14 is manipulated as shown in FIG. 2, compressed air in the main air housing 13 is applied to the first air chamber 22 through the trigger valve 141 and trigger passage 15, and to the second, third, and fourth air chambers 23, 41, 42 through the second passage 231, the third passage 411, and the fourth passage 421, respectively. Therefore, the high-pressure air in the first air chamber 22 and the top spring 5 drive the cylinder 2 to move to its lower dead center, and the high-pressure air in the third air chamber 41 and the bottom spring 7 drive the sleeve valve 4 to move to its lower dead center. The normal valve 6 closes the fluid communication of the second air chamber 23 to the top vent holes 24, and the third air chamber 41 to the top vent holes 24, the piston 3 closes the fluid communication between the cylinder 2 and the intermediate vent holes 25, and the bottom valve 43 closes the fluid communication between the fourth air chamber 42 and the bottom vent holes 26, for stopping high-pressure air into the cylinder 2.

When the trigger 14 is pulled as shown in FIG. 3, the trigger valve 141 closes the fluid communication between the main air housing 13 and the trigger passage 15. Compressed high-pressure air in the first air chamber 22 is discharged to the atmosphere, so that high-pressure air in the second air chamber 23 drives the cylinder 2 to move to its upper dead center. The normal valve 6 opens the fluid communication from the second air chambers 23 to the top vent holes 24, and introduces high-pressure air into the cylinder 2, applied to the piston 3. Thus, the piston 3 rapidly moves toward the nail. In addition, the bottom exhausting hole 17 is opened for discharging compressed high pressure air under the piston 3 to an atmosphere.

Then, when the user releases the trigger 14 as shown in FIG. 5, the trigger valve 141 returns to the original open state so that the first air chamber 22 re-collects high-pressure air. Thus, the cylinder 2 moves downward to return to the original state, and closes the bottom exhausting passage 34. Before the piston 3 moves upward to its upper dead center, the high-pressure air in the third air chamber 41 can be exhausted into the cylinder 2 through the intermediate vent holes 25, and the sleeve valve 4 is driven to move upward by the high-pressure air in the fourth air chamber 42. Thus, the bottom vent valve 43 are opened, and the high pressure air in the fourth air chamber 42 is guided into the bottom region of the cylinder 2 to stably drive the piston 3 to move upward. At this time, the top exhausting passage 33 is opened, the high pressure air remaining in the upper layer of the piston 3 is discharged through the top exhausting hole 16. When the piston 3 is moved to its upper dead center, the intermediate vent holes 25 is closed, the high pressure air in the third air chamber 41 drives the sleeve valve 4 to move downward to its original state. Thus, a single shot cycle is terminated.

Figure 13:
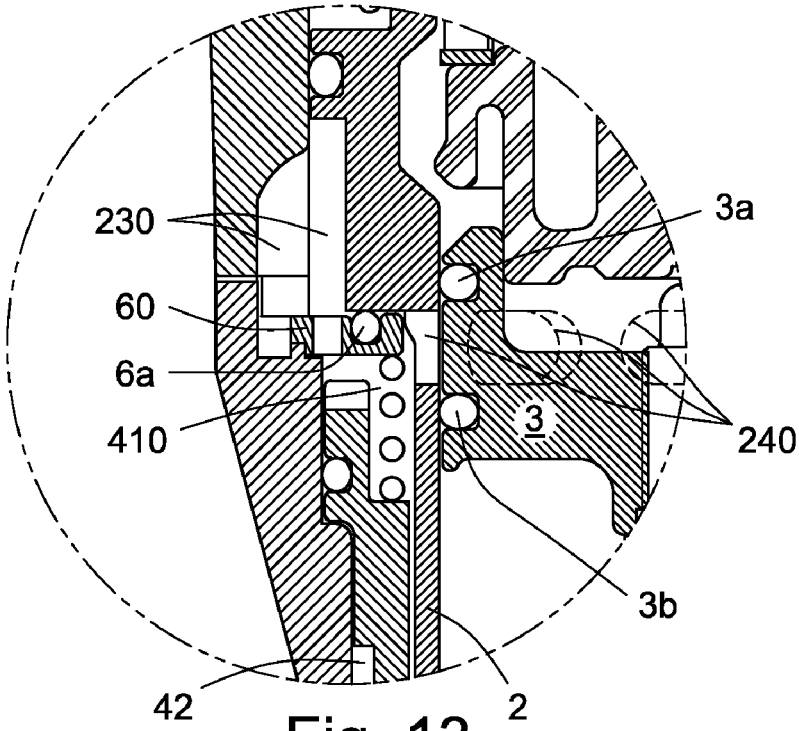
FIG. 13 is a cross-sectional view of a part of a further another alternative pneumatical nail gun according to the present invention, showing a plurality of top vent holes with enlarged area to substitute the intermediate vent holes.
Figure 14:
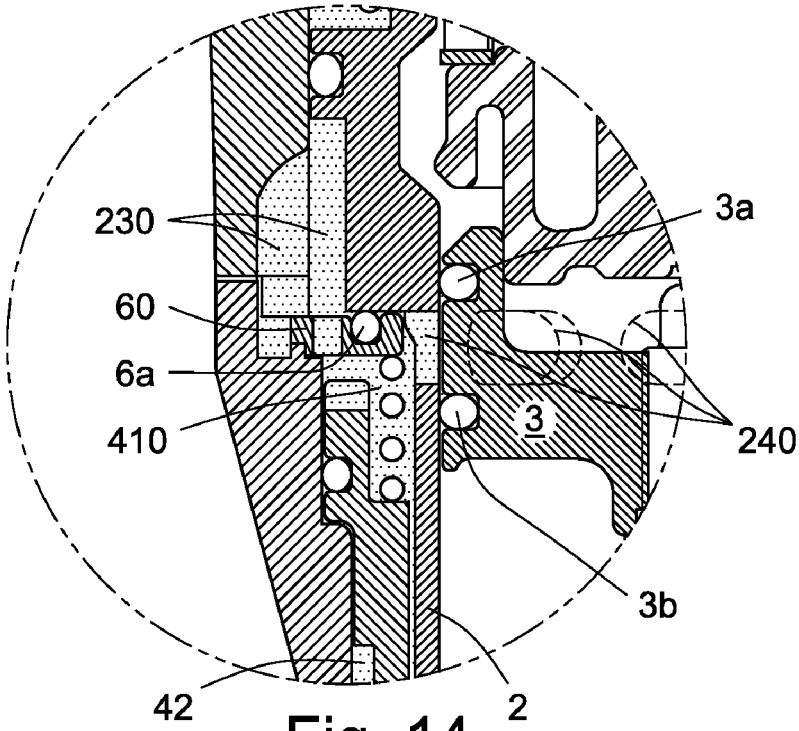
FIG. 14 is an operation state of the pneumatical nail gun of FIG. 13, showing before the trigger is manipulated, the piston close the fluid communication of the second and third air chambers to the cylinder through each top vent hole.
Figure 15:
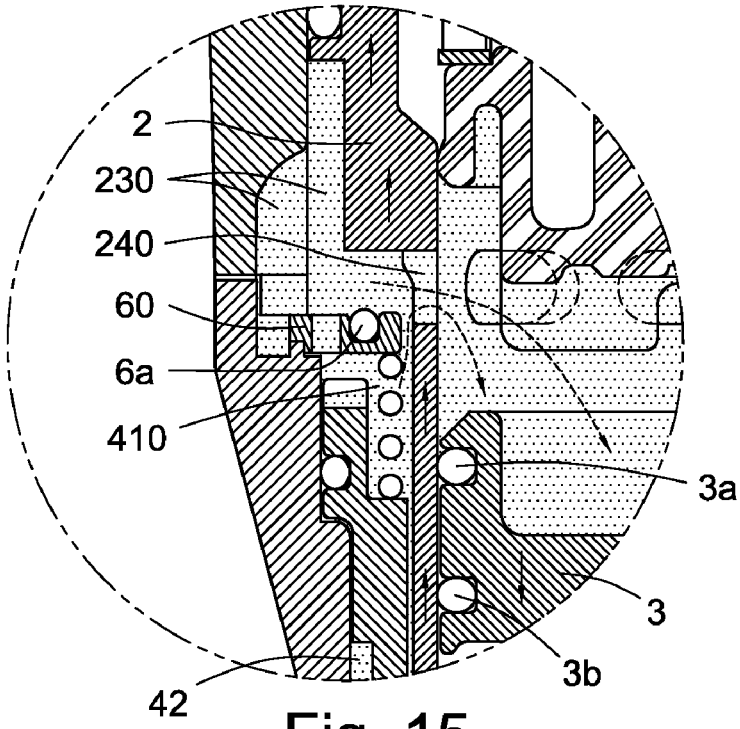
FIG. 15 is an another operation state of the pneumatical nail gun of FIG. 13, showing when the trigger is pressed, each top vent hole guides the high-pressure air in the second and third air chambers continuously into the cylinder for driving the piston move downward to push nails.
Figure 16:
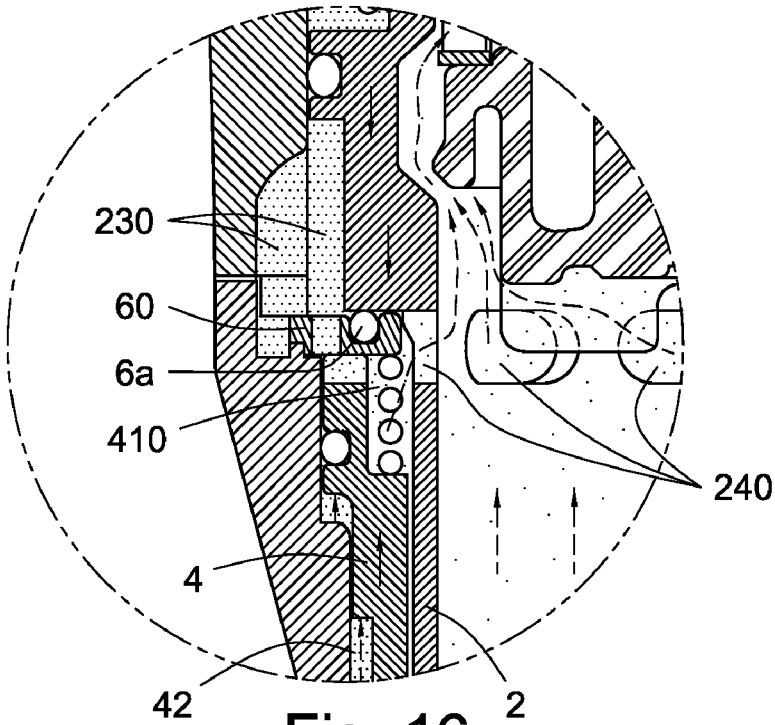
FIG. 16 is a further another operation state of the pneumatical nail gun of FIG. 13, showing after the user releases the trigger and the cylinder moves downward, the high-pressure air in the third air chamber is exhausted to the cylinder through the top vent hole.
Figure 17:
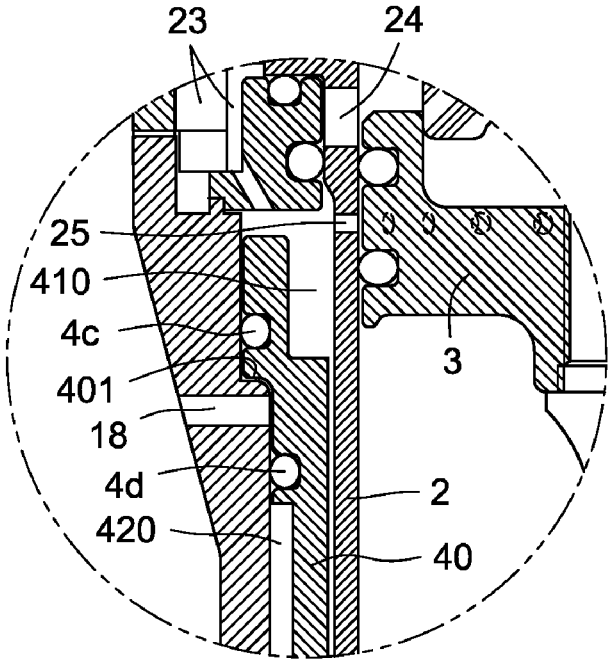
FIG. 17 is a cross-sectional view of a part of a further another alternative pneumatical nail gun according to the present invention, showing a step formed at an peripheral surface of an slidable sleeve valve.
Figure 18:
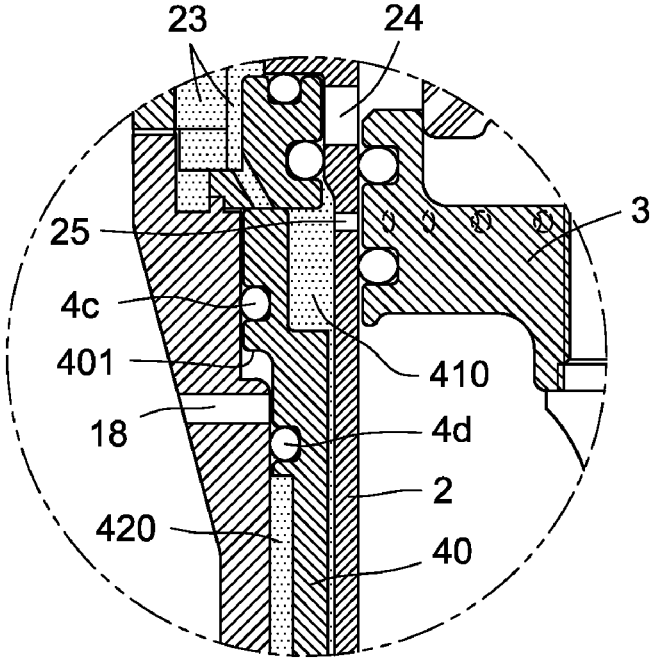
FIG. 18 and FIG. 19 show an operation state of the pneumatical nail gun of FIG. 17, showing an sleeve valve rapidly downward reposition through the pressure thrust of the high pressure air in a third air chamber larger than that in a fourth air chamber.
Figure 19:
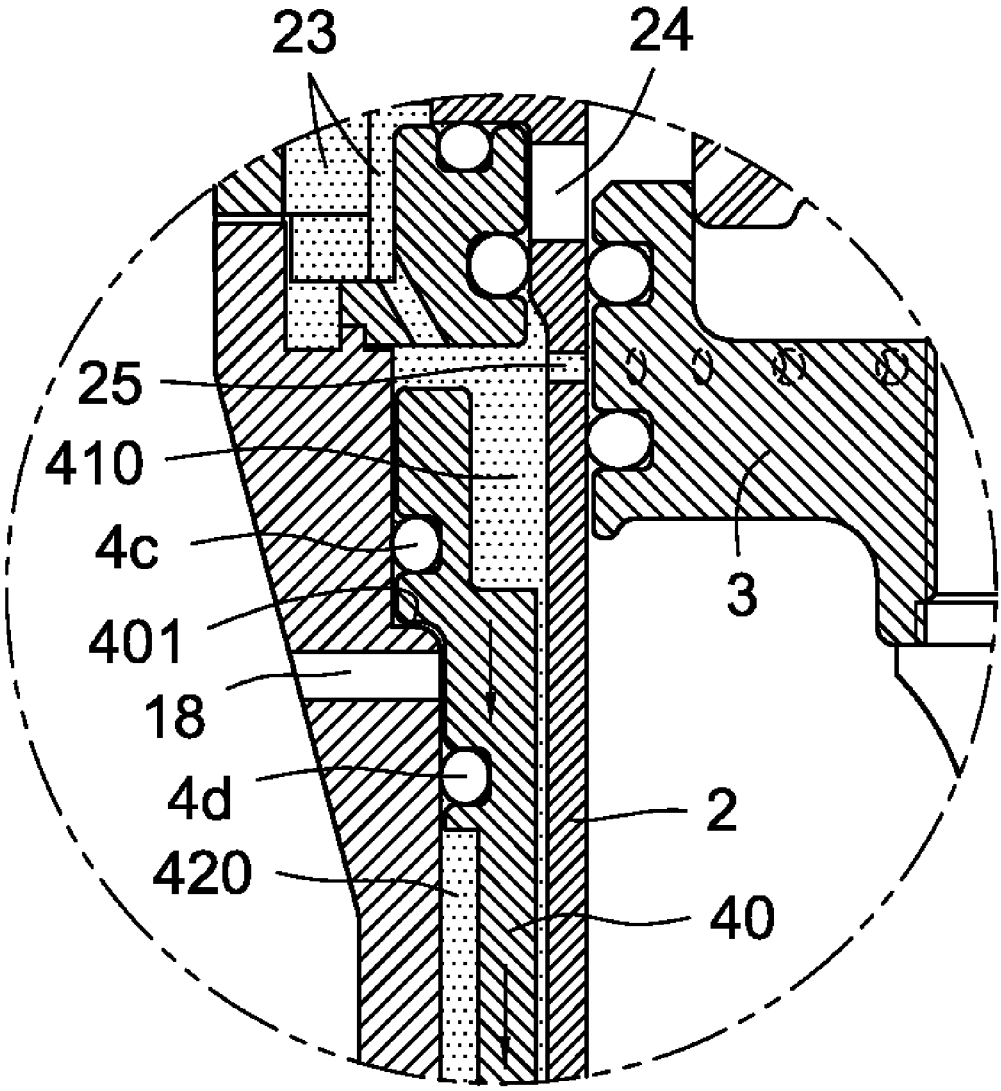

Referring to FIG. 13, a plurality of top vent holes 240 with enlarged area can be used to substitute the above of intermediate vent holes 25 of the movable cylinder 2. That is, each top vent hole 240 is connected to the third air chamber 410. As such, before the trigger is manipulated as shown in FIG. 14, the O-rings 3*a*, 3*b* of the piston 3 can close the fluid communication of the second and third air chambers 230, 410 to the cylinder 2 through each top vent hole 240 and the O-ring 6*a* of a normal valve 60 can close the fluid communication of the second air chamber 230 to each top vent hole 240, while the trigger is pressed to move the cylinder 2 upward as shown in FIG. 15, each top vent hole 240 can also guide the high-pressure air in the second and third air chambers 230, 410 continuously into the cylinder 2 for driving the piston 3 move downward to push nails. Meanwhile, after the user releases the trigger and the cylinder 2 moves downward as shown in FIG. 16, the high-pressure air in the third air chamber 410 can be also exhausted to the cylinder 2 through the top vent hole 240 so that the same effect to move the sleeve valve 4 upward driven by the high-pressure air in the forth air chamber 42 can be achieved. Furthermore, there can be no spring installed inside the third air chamber 410 as shown in FIG. 17. Instead, a step 401 at an peripheral surface of the sleeve valve 40 is provided, two annular ring grooves (not labeled) formed in an outer peripheral surface of the slidable sleeve valve 40, respectively at an upper side and a lower side of the step 401, and two air-tight rings 4*c*, 4*d* assembled in the two ring grooves, respectively. In addition, a gun body has an exhausting hole 18 between the two air-tight rings 4*c*, 4*d*. Thus, as shown in FIG. 18 & FIG. 19, when the slidable sleeve valve 40 moves downward for deposition, the step 401 can decrease the forcing area and the pressure thrust of the high-pressure air in the fourth air chamber 420 and realizes the pressure thrust of the high-pressure air in the third air chamber 410 being larger than that of the high-pressure air in the fourth air chamber 420, which assures the sleeve valve 40 downward deposition when the third and the fourth air chambers 410, 420 are charged with high pressure air therein, and assures the sleeve valve 40 upward deposition when the high-pressure air in the third air chamber 410 is discharged therefrom.

Figure 7:
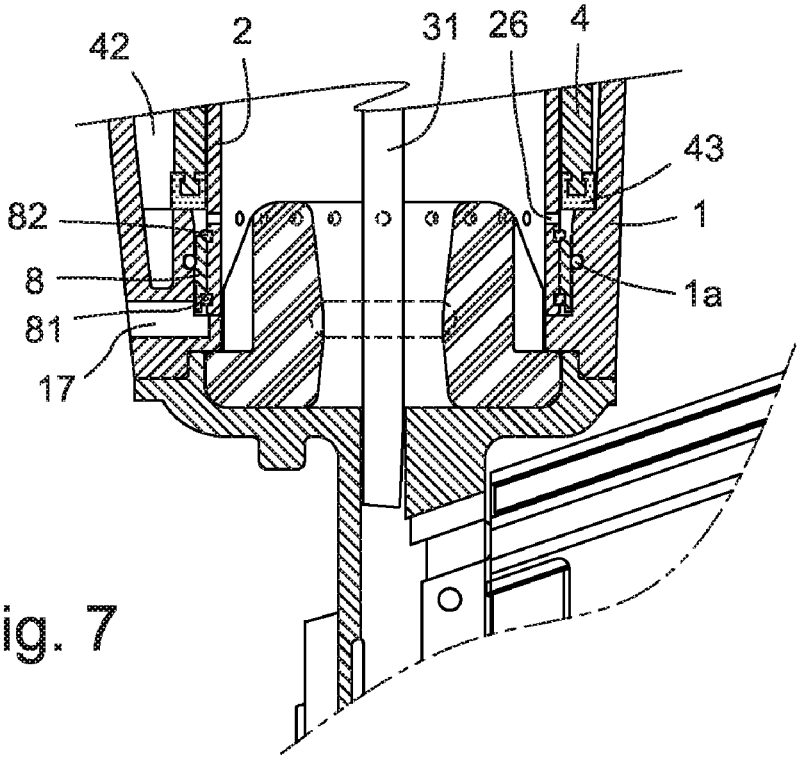
FIG. 7 is a cross-sectional view of a part of an alternative pneumatical nail gun according to the present invention, showing an annular ring stopper formed around an outer peripheral surface of the cylinder.
Figure 8:
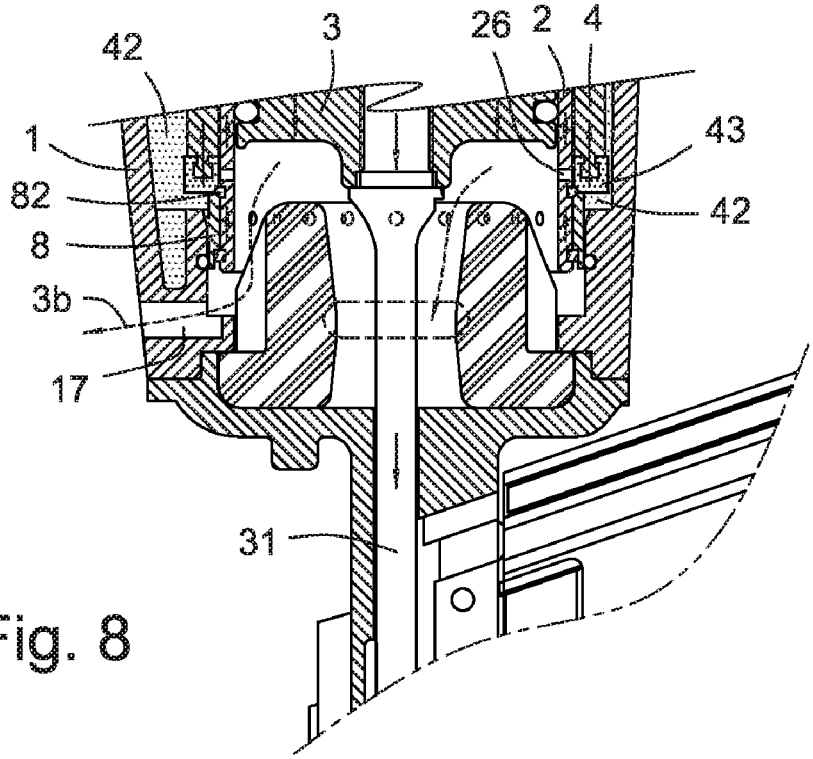
FIG. 8 shows an operation state of the pneumatical nail gun of FIG. 7, showing the annular ring stopper bringing the sleeve valve to move upward at the same time when the cylinder moves upward.
Figure 9:
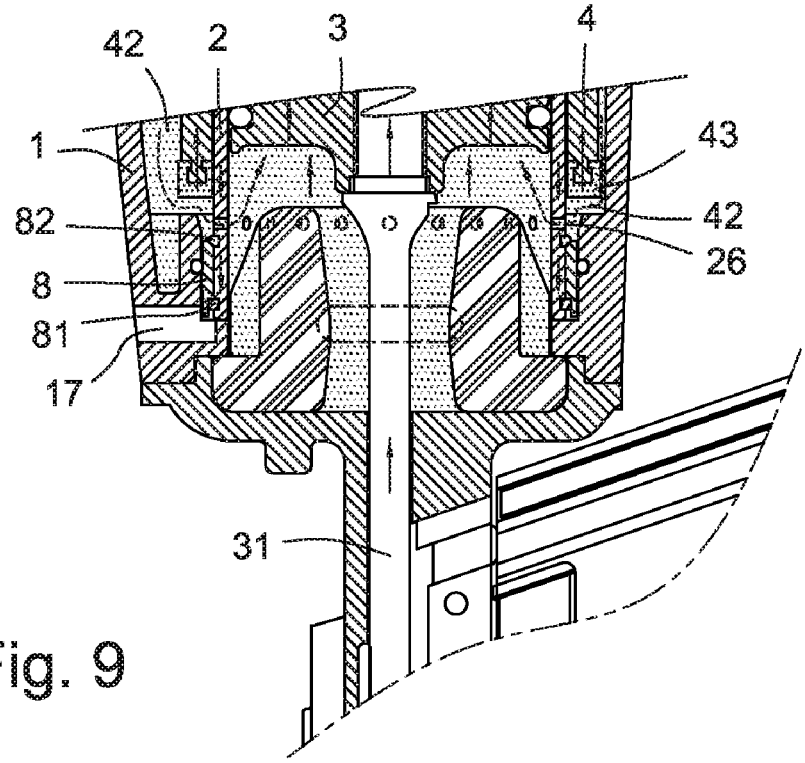
FIG. 9 shows another operation state of the pneumatical nail gun of FIG. 7, showing the sleeve valve keeping in the state through the high pressure air in the fourth air chamber.

In an alternative embodiment, the pneumatic nail gun further has a annular ring stopper 8, which can be integrated on a bottom end of the outer peripheral surface of the cylinder 2 (as shown in FIG. 8), or be fixed through a bottom retain ring 81 and a top O-ring 82 (as shown in FIG. 7). When the cylinder 2 moves upward, the annular ring stopper 8 can bring the sleeve valve 4 to move upward, which lessen the time of upward movement of the sleeve valve 4. That is a sum of upward thrust of the cylinder 2 and the high pressure air in the fourth air chamber 42 is larger than that of the high pressure air in the third air chamber 41, the top spring 5, and the bottom spring 7. And then, the sleeve valve 4 can keep in the state through the high pressure air in the fourth air chamber 42. At this time, the bottom valve 43 and the annular ring stopper 8 and the O-ring 82 can stop the fluid communication between the fourth air chamber 42 and the bottom vent holes 26. After that, when the cylinder 42 returns downward, the fluid communication between the fourth air chamber 42 and the bottom vent holes 26 is opened, the high pressure air can be introduced into the cylinder 2.

Therefore, from above description, it is known that in the above embodiment of the present invention, the pneumatic nail gun utilizes the fourth air chamber 42 continuously receiving the compressed high pressure air from the main air housing 13 to realize the stably upward movement of the piston 3. The pneumatic nail gun can cooperate with a nail injecting mechanism 9 driven by a high pressure air and the elastic deformation force of a spring. A nail injecting passage 18 is further formed in the gun body 1, under the fourth air chamber 42, which fluidly connects with the fourth air chamber 42 and an input passage 91 of the nail injecting mechanism 9. The injecting mechanism 9 further has a nail injecting air chamber 92 fluidly communicating with the input passage 91. In addition, a nail injecting piston 93 and a nail injecting spring 94 is formed in the nail injecting air chamber 92. The nail injecting spring 94 cooperating with the high pressure air in the nail injecting air chamber 92 pushes the nail injecting piston 93 to move and sequentially feed the nails contained in a canister 95 to an injection guiding hole (not labeled).

Figure 10:
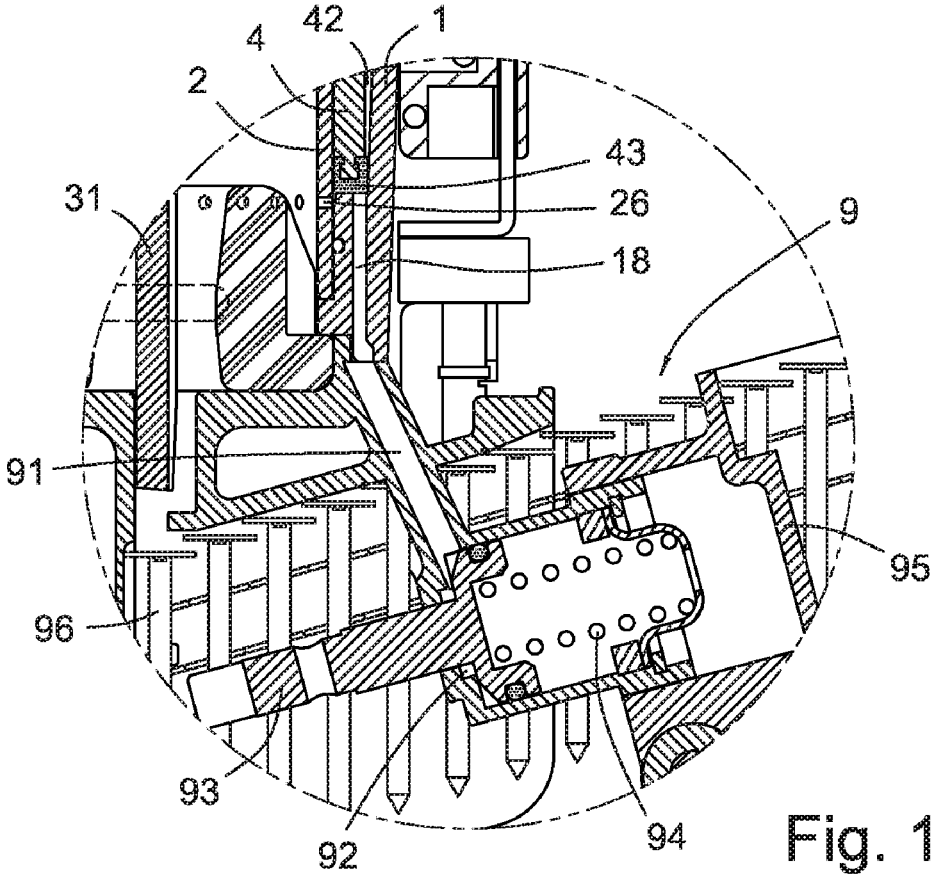
FIG. 10 is a cross-sectional view of a part of an another alternative pneumatical nail gun according to the present invention, showing a nail injecting passage formed at a bottom of the gun body fluidly communicating a fourth air chamber and a nail injecting air chamber.
Figure 11:
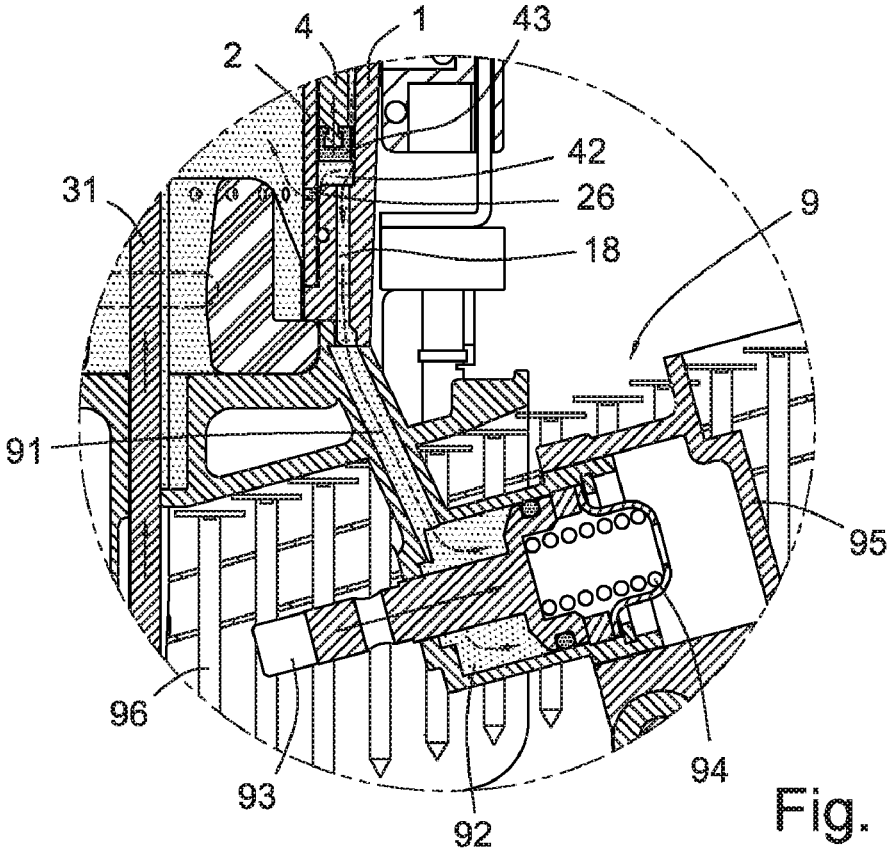
FIG. 11 shows an operation state of the pneumatical nail gun of FIG. 10, showing the nail injecting passage guiding the high pressure air in the fourth air chamber into the nail injecting air chamber for injecting the nails.
Figure 12:
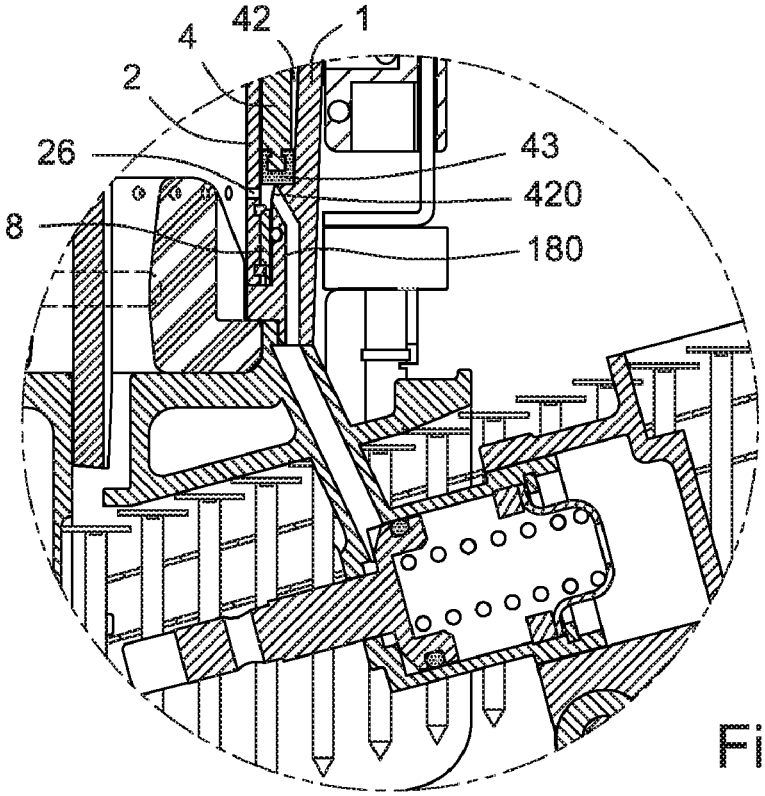
FIG. 12 is a cross-sectional view of a part of a further another alternative pneumatical nail gun according to the present invention, showing the injecting passage connecting a tilted slot formed at a bottom of the fourth air chamber and a plurality of bottom vent holes on the cylinder.

When the sleeve valve 4 moves downward to position, the bottom valve 43 closes the nail injecting passage 18 (as shown in FIG. 7 & FIG. 10). That is the high pressure air in the fourth air chamber 42 can not be introduced into the nail injecting air chamber 92 through the nail injecting passage 18. When the sleeve valve 4 moves upward, the bottom valve 43 opens and the high pressure air in the fourth air chamber 42 is guided into the bottom region of the cylinder 2 to stably drive the piston 3 move upward. At the same time, a part of the high pressure air in the fourth air chamber 42 is guided into the nail injecting air chamber 92 through the nail injecting passage 18 and the input passage 91 of the nail injecting mechanism 9. The high pressure air in the nail injecting air chamber 92 injects the nails contained in the canister 95 to an injection guiding hole (not labeled).

In an alternative design, the nail injecting passage 18 can be designed directly connecting with a tilted opening 420 formed at a bottom of the fourth air chamber 42. In addition, the tilted opening 420 further connects with the bottom vent holes 26. Thus, the bottom valve 43 can control the high pressure in the fourth air chamber 42 passing to the nail injecting passage 18 or the bottom vent holes 26.

The above description is given by way of example, and not limitation. Given the above disclosure, one skilled in the art could devise variations that are within the scope and spirit of the invention disclosed herein, including configurations ways of the recessed portions and materials and/or designs of the attaching structures. Further, the various features of the embodiments disclosed herein can be used alone, or in varying combinations with each other and are not intended to be limited to the specific combination described herein. Thus, the scope of the claims is not to be limited by the illustrated embodiments.

What is claimed is:

1. A pneumatic nail gun comprising:

a gun body, which has a main air housing collecting a compressed high pressure air with a constant pressure, and a trigger at one end of the main air housing driving the high pressure air to shoot a nail;

a movable cylinder disposed in the main air housing, which moves upward when the trigger is pressed, and moves downward for reposition when the trigger is released;

a piston slidably movable in the cylinder, which has a driver blade extending from the piston, which protrudes out of the gun body for punching against a nail in accordance with a downward movement of the piston;

a slidable sleeve valve assembled at an outer peripheral surface of the cylinder, which moves upward and introduces high pressure air to drive the piston move upward when the cylinder moves downward to a lower dead center thereof, and is driven downward for reposition by high pressure air after the piston moves to an upper dead center thereof;

a head valve positioned above and integrated on the cylinder;

a first air chamber formed between a top end of the head valve and an inner peripheral surface of the gun body, which receives the high pressure air from the main air housing when the trigger is released, and exhausts the high pressure air when the trigger is pressed;

a second air chamber formed between the head valve and inner peripheral surface of the gun body, which receives the high pressure air from the main air housing and drives the cylinder move upward when the high-pressure air in the first air chamber is discharged;

a third air chamber positioned between the slidable sleeve valve and the inner peripheral surface of the gun body, which receives the high pressure air from the main air housing for driving the slidable sleeve valve to move downward;

a plurality of top vent holes formed on the cylinder, which connect with the third air chamber for guiding the high-pressure air in the second air chamber continuously into the cylinder for driving the piston to move downwardly to punch the nail when the trigger is pressed to move the cylinder upward and guiding the high-pressure air in the third air chamber into the cylinder when the trigger is released to move the cylinder downward;

a fourth air chamber formed between an inner peripheral surface of the gun body and an outer peripheral surface of the slidable sleeve valve, which receives the high pressure air from the main air housing for driving the slidable sleeve valve to move upwardly when the high-pressure air in the third air chamber is discharged;

a plurality of bottom vent holes formed at a bottom region of the cylinder; and a bottom valve fixedly positioned at a lower end portion of the slidable sleeve valve, which can close the fluid communication between the fourth air chamber and the bottom vent holes when the slidable sleeve valve moves downward, and guide the high-pressure air in the fourth air chamber into the cylinder to drive the piston for reposition when the slidable sleeve valve moves upward.

2. The pneumatic nail gun as claimed in claim 1, wherein a bottom spring is disposed in the third air chamber, a sum of an elastic deformation force of the bottom spring and a pressure thrust of the high-pressure air in the third air chamber being larger than a pressure thrust of the high-pressure air in the fourth air chamber, and the single elastic deformation force of the bottom spring being smaller than the pressure thrust of the high-pressure air in the fourth air chamber.

3. The pneumatic nail gun as claimed in claim 1, wherein a normal valve is formed at one end of the third air chamber, which has a plurality of normal valve vent holes connecting the third passage and the third air chamber for the fluid communication therebetween, and a sum of an actual communication area of the plurality of normal valve vent holes is greatly smaller than that of the plurality of top vent holes.

4. The pneumatic nail gun as claimed in claim 1, wherein the top vent holes are opened when the piston moves downward for punching the nail and are closed when the piston moves upward for reposition.

5. The pneumatic nail gun as claimed in claim 1, further comprising a nail injecting passage formed in a bottom of the gun body, which connects with the fourth air chamber, the nail injecting passage being closed by the bottom valve when the sleeve valve moves downward, and guiding the high pressure air in the fourth air chamber to inject the nail when the sleeve valve moves upward.

6. The pneumatic nail gun as claimed in claim 5, wherein the nail injecting passage connects with the bottom valve through a tilted slot at a bottom of the fourth air chamber, and is controlled by the bottom valve.

7. The pneumatic nail gun as claimed in claim 1, further comprising a step at an upper peripheral surface of the slidable sleeve valve, two air-tight rings assembled in an outer peripheral surface of the slidable sleeve valve, respectively, and an exhausting hole at the gun body between the two air-tight rings for decreasing the forcing area and the pressure thrust of a high-pressure air in the fourth air chamber.

* * * * *